United States Patent [19]

Brendlinger

[11] Patent Number: 5,031,253

[45] Date of Patent: Jul. 16, 1991

[54] METHOD OF MAKING A SANITARY TOILET ANTI-SPLASH AND SILENCER DEVICE AND ARTICLE PRODUCED THEREBY

[76] Inventor: Dirck L. Brendlinger, 111 Burgoyne Rd., Richmond, Va. 23229

[21] Appl. No.: 554,893

[22] Filed: Jul. 20, 1990

[51] Int. Cl.[5] ..... E03D 9/00

[52] U.S. Cl. ..... 4/300.3; 4/661; 428/913; 428/69

[58] Field of Search ..... 428/913, 69, 72; 4/661, 4/300.3

[56] References Cited

U.S. PATENT DOCUMENTS

| | | | |
|---|---|---|---|
| 2,913,047 | 4/1960 | Stebbins | 4/300.3 |
| 3,212,104 | 10/1965 | Stevens | 4/300.3 |
| 3,383,710 | 5/1968 | Sumner | 4/300.3 |
| 3,614,790 | 10/1971 | Billingsly | 4/300.3 |
| 4,010,497 | 3/1977 | Merter et al. | 4/300.3 |
| 4,062,070 | 12/1977 | Prince | 4/300.3 |
| 4,215,443 | 8/1980 | Babik | 4/300.3 |
| 4,744,113 | 5/1988 | Kogut | 4/661 |
| 4,852,201 | 8/1989 | Wundrock et al. | 15/145 |

FOREIGN PATENT DOCUMENTS

WO87/06289 10/1987 PCT Int'l Appl. ..... 4/661

OTHER PUBLICATIONS

Trademark Register 1222579, 1-4-83.

*Primary Examiner*—Henry J. Recla
*Assistant Examiner*—Glenn T. Barrett
*Attorney, Agent, or Firm*—Richard P. Matthews

[57] ABSTRACT

A method of making a sanitary toilet anti-splash and silencer device and an article produced thereby. A floatable member is formed from two or more layers or sheets of biodegradable paper. The layers are joined together by an adhesive pattern which establishes individual compartments between the layers. A gas forming agent is placed in at least a plurality of the compartments. The gas forming agent releases a gas such as $CO_2$ when exposed to water thereby providing buoyancy when the device is placed on the water in a toilet. The device may have a target indicia imprinted thereon and it may be provided with a paper strip or string so that the device may be positioned or held in place in the toilet.

6 Claims, 1 Drawing Sheet

METHOD OF MAKING A SANITARY TOILET ANTI-SPLASH AND SILENCER DEVICE AND ARTICLE PRODUCED THEREBY

This invention relates to a method of making a sanitary toilet anti-splash and silencer device and the article produced thereby.

BACKGROUND OF THE INVENTION

Heretofore, it has been known to reduce the embarrassing and undesirable noises associated with urination especially when this occurs in relatively tight or compact quarters. U.S. Pat. No. 3,383,710 issued to Sumner on May 21, 1968 attempted to solve the problem by introducing a foam into the toilet immediately prior to urination. The foam completely covers the surface of the water in the toilet. The foam is dispensed from a tablet, liquid or spray. Because the foam engages the sides of the toilet, the problem of a residual film sticking to the sides of the toilet is presented. When the user is required to use a liquid or spray, another problem of applying too much or too little of the foam arises.

Another solution was proposed in U.S. Pat. No. 4,062,070 issued to Prince on Dec. 13, 1977. This device consists of a floating, rotatable ball that is secured to the side of the toilet bowl. The rotatable ball is coated with a non-stick coating and remains in the toilet at all times. Cleanliness of the rotatable ball becomes a problem with passage of time.

SUMMARY OF THE INVENTION

The foregoing limitations and shortcomings of the known prior art are effectively overcome in the practice of the present invention. In particular, a sanitary anti-splash and silencer device is provided which is flushed with each usage of the toilet. The device does not leave any residue on the sides of the toilet bowl because the device is self contained within sheets of biodegradable paper.

The essence of the device and its construction will become more readily apparent upon considering the following principal method steps in its manufacture:

1. An adhesive pattern is laid out on a first sheet of biodegradable paper by forming a plurality of closed loops of adhesive which provide the basis for sealed compartments in the manufactured device.

2. A gas forming agent is placed in all or at least some of the closed loop adhesive pattern. This gas forming agent produces a gas when exposed to water such as the water in the toilet bowl.

3. A second sheet of biodegradable paper is attached to the first sheet by means of the adhesive pattern on the first sheet. Therefore, raised compartments which contain gas are formed by the adhesive securement of the two sheets and this provides buoyancy and convex outer surfaces when The inherent advantages and improvements of the present invention will become manifest upon reference to the following detailed description of the invention and by reference to the drawing wherein.

DETAILED DESCRIPTION OF THE INVENTION

Figure 3:
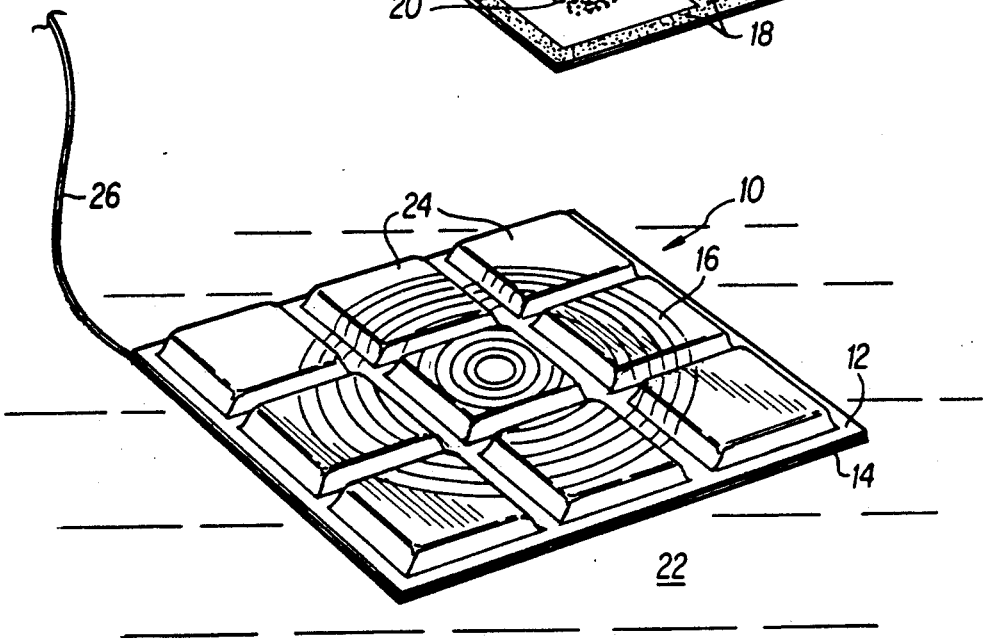
FIG. 3 is a perspective view of the sealed package of components when placed in the water of a toilet bowl shown with means to position the device therein.

Referring nov to the drawings, an anti-splash and silencer device of the present invention is indicated generally at 10 in FIG. 3. The device is constructed from a upper sheet or layer 12 of biodegradable paper and a lower sheet or layer 14 of biodegradable paper. More sheets or layers may be employed so long as it is strong enough to withstand the force of the urinary stream without disintegrating, but light enough so that it can be used and then flushed from the toilet. One or both of the outer layers may have an imprinted target 16 thereon.

Figure 1:
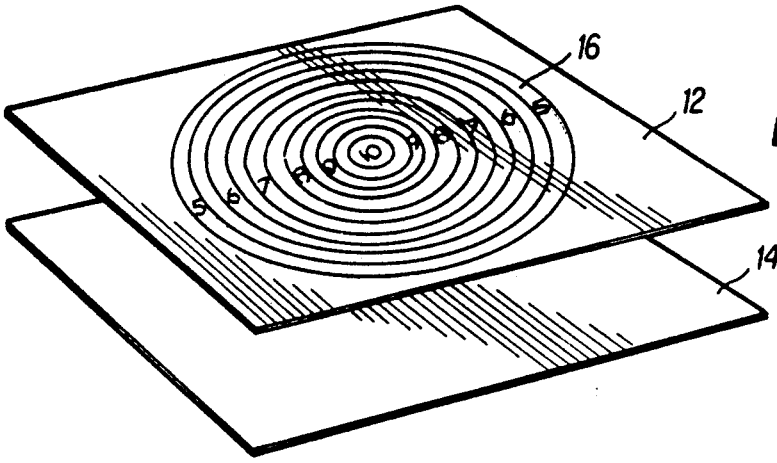
FIG. 1 is an exploded perspective view of two sheets of material used in the formation of the anti-splash and silencer device of the present invention.
Figure 2:
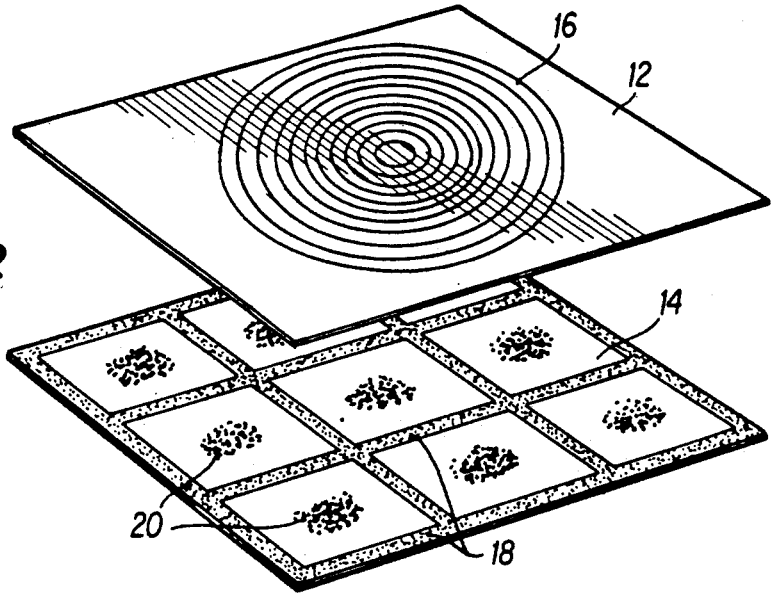
FIG. 2 is an exploded perspective view similar to FIG. 1 with a plurality of closed loop adhesive patterns on one sheet and a gas forming substance placed within the closed loop adhesive patterns.

Reference to FIG. 2 shows that an adhesive pattern 18 forms a plurality of closed loops and is shown applied to sheet 14. While the closed loops are illustrated to be rectangular in FIG. 2, it is to be expressly understood that the closed loop patterns can be so configured as to define facial features, the outlines of animals or clowns, or the like, so as to be entertaining for children.

Within some or all of the closed loops formed by adhesive pattern 18, is placed a gas forming agent, such as sodium bicarbonate, which releases carbon dioxide ($CO_2$) when exposed to water. The sheets are pressed together and a plurality of closed compartments 24 are provided when the device is placed in water 22 of a toilet bowl. This provides buoyancy for the device 10 when placed in the toilet bowl. Additionally, the outer surface of each compartment provides a convex surface which deflects a stream of urine away from its source.

As an optional feature, the device 10 may be provided either at one corner or along one of its sides with a strip of paper or string 26 which serves to position the device 10 or to maintain it in a given location.

In merchandising this product, it should be recognized that the gas forming agent must be protected from moisture. Therefore, the device must be enclosed individually or in groups in a waterproof wrapper such as in plastic, foil, waxed paper or other moisture proof material designed for each opening and reclosure as needed.

Attractive patterns and colors can be used in tasteful designs for both the device and its container. A box containing the devices can be placed on the toilet tank at home or at work.

To make the urination experience more rewarding and perhaps even exhilerating, the imprinted target 18 may present words like, "THE BOSS", "MOTHER-IN-LAW", "DEMOCRAT", or "REPUBLICAN". This may also permit the user to vent his or her hostilities very quietly.

While a presently preferred embodiment of the invention has been illustrated and described, it will be recognized that the invention may be otherwise variously embodied and practiced within the scope of the claims which follow.

I claim:

1. A method of making a sanitary toilet anti-splash and silencer device which comprises:

a. laying out an adhesive pattern on a first sheet of biodegradable paper to form a plurality of compartments, b. placing a gas forming agent within at least some of said compartments, i. said gas forming agent producing a gas when exposed to water, c. attaching a second sheet of biodegradable paper to said first sheet of biodegradable paper whereby raised compartments are formed between said first and second sheets of biodegradable paper providing buoyancy when said device is placed in the water of a toilet.

2. A method of making a sanitary toilet anti-splash and silencer device as defined in claim 1 including the additional step of printing a target indicia on at least one of said sheets of biodegradable paper.

3. A method of making a sanitary toilet anti-splash and silencer device as defined in claim 1 including the additional step of attaching a means for positioning said device as it floats on the water of a toilet.

4. In a device for minimizing noise and splashing associated with urination in a toilet, the combination which comprises:

a. a floatable member formed from at least two layers of biodegradable paper, b. said layers of biodegradable being joined together by an adhesive pattern which establishes individual compartments between said layers with at least a plurality of said compartments being provided with a gas forming agent which releases a gas when exposed to water to provide buoyancy when said device is placed on water in a toilet.

5. In a device as defined in claim 4 wherein at least one of said layers of biodegradable paper has a target indicia imprinted thereon.

6. In a device as defined in claim 4 including means attached to said device for positioning it as it floats on the water of a toilet.

* * * * *